United States Patent [19]

Steenson et al.

[11] Patent Number: 4,496,504

[45] Date of Patent: Jan. 29, 1985

[54] METHOD OF EXPOSING AGGREGATE IN A POURED CONCRETE PANEL

[76] Inventors: Thomas W. Steenson, 408A Marybay Cres., Richmond Hill, Ontario, Canada, L4C 2X4; William D. Paton, 14 Steeplechase Ave., Aurora, Ontario, Canada, L4G 3G8

[21] Appl. No.: 508,737

[22] Filed: Jun. 29, 1983

[51] Int. Cl.[3] ..... B28B 3/12

[52] U.S. Cl. ..... 264/69; 264/139; 264/333; 249/18; 425/456

[58] Field of Search ..... 425/62, 218, 456; 264/256, 333, 162, 69, 70, 139; 249/18; 404/113, 117, 122

[56] References Cited

U.S. PATENT DOCUMENTS

| | | | |
|---|---|---|---|
| Re. 27,109 | 3/1971 | Videen | 264/162 |
| 3,469,000 | 9/1969 | Smith | 264/256 |
| 3,824,055 | 7/1974 | Shoe et al. | 425/218 |

*Primary Examiner*—James Lowe
*Assistant Examiner*—Mary Lynn Fertig
*Attorney, Agent, or Firm*—Fetherstonhaugh & Co.

[57] ABSTRACT

A method of making a cast concrete panel with coarse aggregate exposed on its upper face as cast comprising the steps of pouring and compacting wet concrete having a coarse aggregate content into a casting bed, levelling the upper surface of the concrete to the desired height by means that includes the passage thereover of a screed roller rotating in a direction to push excess surface concrete in advance of the screed roller, lifting coarse aggregate towards the upper surface of the concrete in advance of the screed roller by passing the free ends of rotating aggregate lifter arms through the concrete, the aggregate lifter-arms being spaced apart a distance to support coarse aggregate therebetween, whereby to lift and concentrate coarse aggregate in the wet concrete towards the surface, and to deposit a high concentration of coarse aggregate in front of said screed roller, said aggregate lifter arms being mounted radially of a rotating shaft that rotates in the opposite direction to the direction of rotation of the screed roller, compacting the concentrated coarse aggregate to leave cement and fine aggregate as an overlay to the compacted coarse aggregate by the passage over the surface layer of a compacting roller that is rotated in the opposite direction to the screed roller with respect to the direction of travel of roller rotation along the casting bed to compact coarse aggregate and deposit cement and fine aggregate as an overlay as aforesaid, permitting the body of the concrete to cure, and exposing the coarse aggregate on the upper face by removing cement and fine aggregate from between the coarse aggregate to expose the coarse aggregate on the flat upper surface of the panel as cast.

2 Claims, 5 Drawing Figures

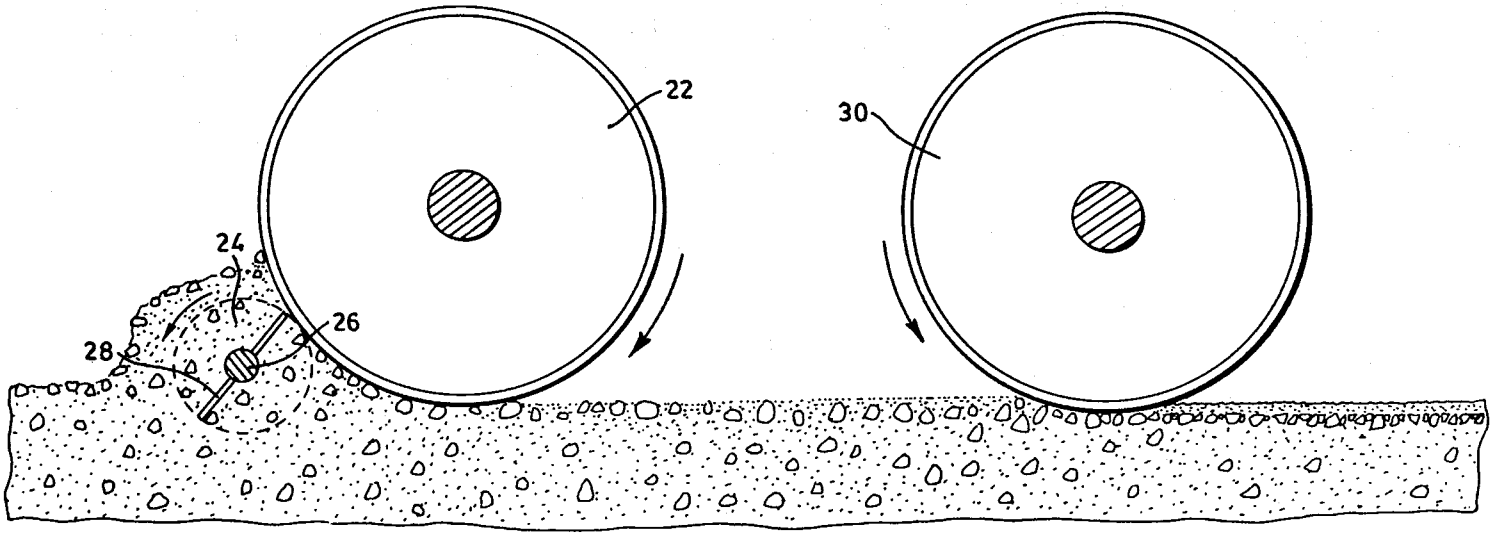
FIG. 2
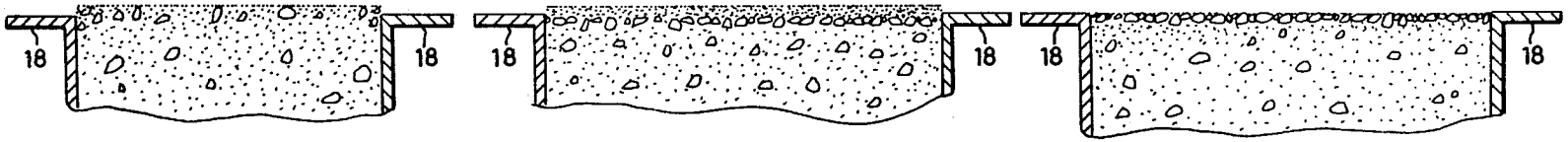
FIG. 5
FIG. 4
FIG. 3

METHOD OF EXPOSING AGGREGATE IN A POURED CONCRETE PANEL

This invention relates to a method for making a cast concrete panel with the coarse aggregate of the concrete exposed on one face and to a concrete finishing machine.

It is common building practice to make wall panels from concrete. These panels are cast in a long line process wherein continuous steel side forms spaced apart the width of a panel (usually 8 to 10 feet) extend upwardly from a bottom form to define the width of the panel. Transverse bulk heads extend between the side forms to define the panel length. The panels can also be cast continuous and cut to length.

The general process is to pour wet concrete into the form, compact the concrete with a vibrating screed and then level it with roller screeds. In some cases, ribs are formed in the upper surface of the concrete for an ornamental effect.

Concrete usually comprises coarse aggregate, fine aggregate, cement, additives and water. The coarse aggregate can vary in nature and often an ornamental coarse aggregate is chosen and exposed on one face of the panel for architectural effect. The exposure of the coarse aggregate is achieved by applying a retarder to the concrete at the face to be ornamented that retards the curing process at the surface. When the concrete of the panel as a whole has cured the surface to be ornamented is brushed or otherwise abraded to remove the cement and fine aggregate between the coarse aggregate whereby to leave the coarse aggregate exposed on the face of the panel.

Prior to this invention the best quality panels with coarse aggregate exposed have been cast with the exposed aggregate face down. The general process is to apply a curing retarder to the bottom of the mould, cast the concrete in the mould, permit the concrete to set, remove it from the mould and then expose the aggregate on the underside of the mould by removing the fine aggregate and cement that is between the coarse aggregate from the surface.

A good quality panel requires that the coarse aggregate be concentrated at the surface where it is to be exposed. When the surface to be exposed is the surface on the underside of the mould, it is not at all difficult to achieve a good and even concentration of the coarse aggregate at the bottom surface. The conventional method of insuring that the coarse aggregate is concentrated at the lower surface is to pack the wet concrete in the mould with a grid vibrator. The grid vibrator tends to force the aggregate to the bottom surface for subsequent exposure as to form.

The foregoing method of making a panel with aggregate exposed on a face thereof is one that produces a good quality product but it is expensive because the inside face of the panel has to be trowelled manually if used as a finished interior wall.

A principal use of exposed aggregate panels is on industrial buildings and warehouses where the user does not want, or is not willing to pay for, an expensive finish, but still wants an attractive, economical panel which would probably be insulated as well.

Normally, exposed aggregate panels used in office buildings are completely covered on the inside with insulation and/or drywall so that the inside finish on the actual panel is not critical. However, in many circumstances of use of the present panels, they make up a complete wall which is expected to be smooth on the inside to receive paint or to be left exposed as cast. This is one of the advantges of face-up finishing. This means that the inside of the panel automatically has a smooth steel form finish. If the panels were cast face-down, then the top surface, which is the inside finish, would have to be finished manually by steel trowell or some other means.

Panels wherein aggregate is exposed on the upper face as cast have been made, but with the latter method it has not been easy to duplicate the finish of the method where the aggregate is exposed on the lower face as cast. It has been found difficult to produce an acceptable exposed aggregate finish with a reasonable percentage of the aggregate exposed. The reason is that during the moulding process the poured concrete has to be vibrated with a screed vibrator. The use of the screed vibrator tends to settle the coarse aggregate a substantial distance below the surface of the panel and when an attempt is made to expose the aggregate at the surface layer there is not enough aggregate showing to make a good quality product.

Attempts have been made to overcome the shortcomings of panels where the upper face as cast is exposed. For example, after screed vibrating and leveling attempts have been made to apply dry aggregate to the surface and work it into the face of the panel by manual labour. The appearance is improved because there is more coarse aggregate exposed on the surface, but it has been found difficult to achieve a consistant appearance over the whole panel. The skill of the workman enters into the quality of the product.

A further method is to apply a face mix to a moulded panel, the face mix having a high concentration of coarse aggregate. This method is not a very good production method because it involves carefully keeping the top of the principal concrete panel about an inch below the top of the form and adding a one inch layer of special mix to the top. The method is labour intensive and involves an extra operation during the production process.

This invention provides a method of making a cast concrete panel with coarse aggregate exposed on the upper face as cast that is automatic, that achieves a consistent result that achieves a good percentage exposure of the coarse aggregate and that is capable of producing a very competitively priced product. It produces a good quality product at a low price.

A method of making a cast concrete panel with coarse aggregate exposed on its upper face as cast according to this invention comprises the steps of pouring and compacting wet concrete having a coarse aggregate content into a casting bed, levelling the upper surface of the concrete to the desired height by means that includes the passage thereover of a screed roller rotating in a direction to push excess surface concrete in advance of the screed roller, lifting coarse aggregate towards the upper surface of the concrete in advance of the screed roller by passing the free ends of rotating aggregate lifter arms through the concrete, the aggregate lifterarms being spaced apart a distance to support coarse aggregate therebetween, whereby to lift and concentrate coarse aggregate in the wet concrete towards the surface, and to deposit a high concentration of coarse aggregate in front of said screed roller, said aggregate lifter arms being mounted radially of a rotating shaft that rotates in the opposite direction to the direction of rotation of the screed roller, compacting the concentrated coarse aggregate to leave cement and fine aggregate as an overlay to the compacted coarse aggregate by the passage over the surface layer of a compacting roller that is rotated in the opposite direction to the screed roller with respect to the direction of travel of roller rotation along the casting bed to compact coarse aggregate and deposit cement and fine aggregate as an overlay as aforesaid, permitting the body of the concrete to cure; and exposing the coarse aggregate on the upper face by removing cement and fine aggregate from between the coarse aggregate to expose the coarse aggregate on the flat upper surface of the panel as cast.

A machine according to the invention comprises a wheeled motorized frame, a vertical roller operable in said frame as a screed, a vertically adjustable aggregate lifter in said frame in advance of said roller where it is operable as a screed, said aggregate lifter comprising a driven rotatably mounted shaft with aggregate lifting arms extending radially thereof in spaced relation longitudinally of said shaft to entrain and lift coarse aggregate of a concrete mix as it rotates.

In the drawings:

FIG. 2 is a schematic illustration of the operation of the lifter, screed roller and packing roller;

FIG. 3 is a cross-sectional illustration of the casting bed behind the screeding roller;

FIG. 4 is a cross-sectional illustration of the casting bed behind the packing roller; and FIG. 5 is an illustration of the panel in the casting bed after the coarse aggregate has been exposed as to form.

Figure 1:
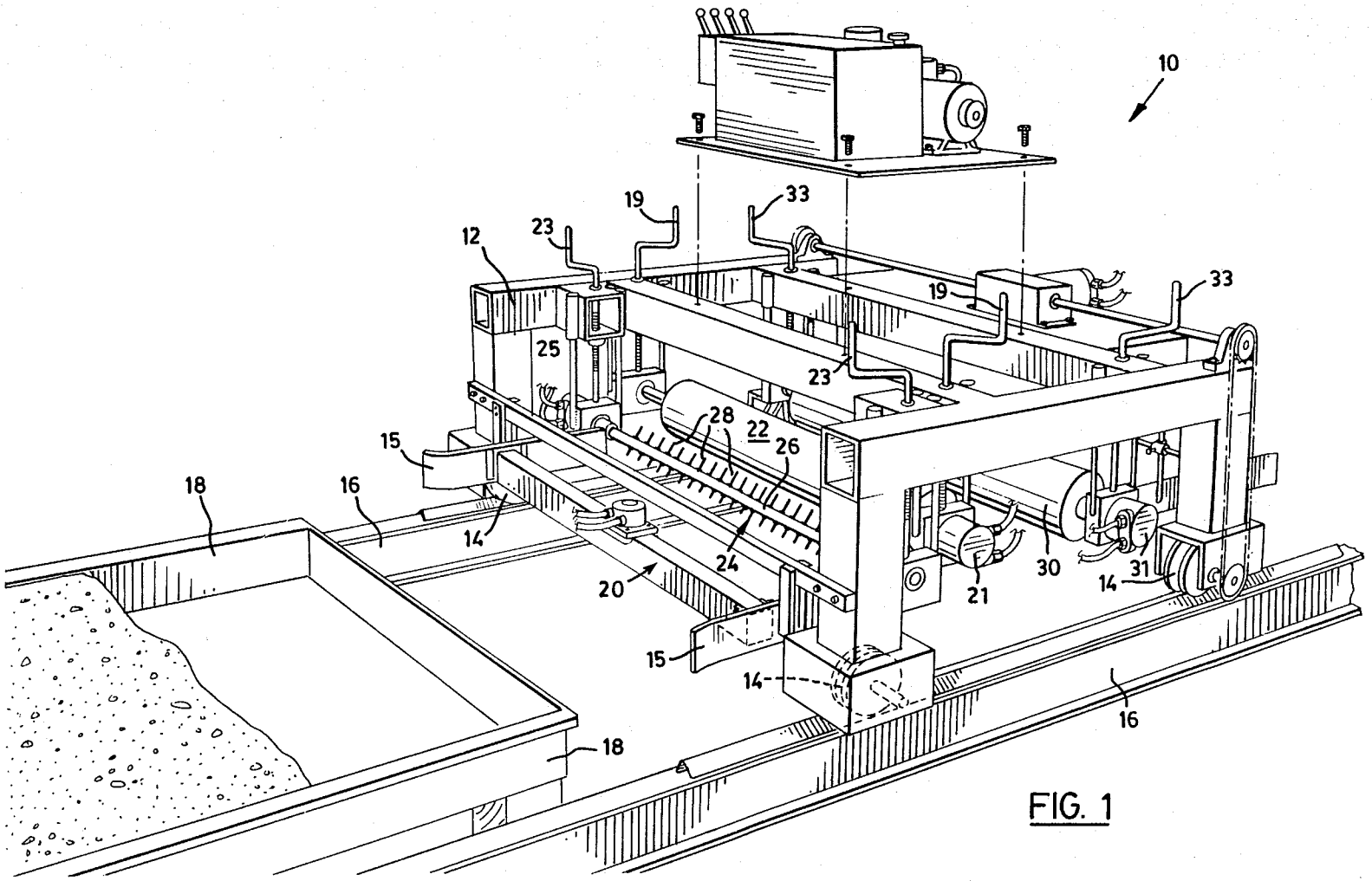
FIG. 1 is a schematic illustration of a finishing machine for concentrating coarse aggregate near the upper face of a concrete panel as it screeds and levels the concrete.

Referring to the drawings, the numeral 10 generally refers to a concrete finishing machine according to the invention. It has a frame 12 with hydraulic motor driven wheels 14 that ride on tracks 16 that are outboard of the side forms 18 of the mould where the concrete panels are cast. The carriage 12 has a hydraulic motor operated vibrating screed generally indicated by the numeral 20 at its front. A screed roller 22 is mounted behind the vibrating screed and an aggregate lifter generally indicated by the numeral 24 is mounted in advance of the screed roller. Aggregate lifter 24 has a rotatably mounted shaft 26 and a plurality of spaced apart radially extending arms 28. It is raised or lowered with respect to the frame by cranks 23 and rotated by hydraulic motor 25. Motor 21 rotates screed roller 22 and cranks 19 adjust its height. Scrapers 15 ride on the edge of the forms to prevent side spillage.

The screed roller 22 is rotated in a direction to carry concrete in advance of the machine as indicated and the aggregate lifter 24 is rotated in the opposite direction to the screed roller to lift coarse aggregate from the layer of concrete in the mould that is near the surface thereof and to direct it toward the screed roller which follows it. The arms 28 are spaced apart on shaft 26 a distance to entrap coarse aggregate in the mix therebetween and lift it towards the surface.

It will be apparent that by lifting the aggregate in the layer of concrete close to the surface that the coarse aggregate will be concentrated at the surface so that as it is levelled by the screeding roller there is a concentration of coarse aggregate close to the upper surface of the panel.

The combined operation of the aggregate lifter 24 and screed 22 is illustrated in FIG. 2; the lifter lifts aggregate and the screed levels the mix. The surface of the concrete following passage of the screeding roller is illustrated in FIG. 3 and it will be noted that the illustration shows a concentration of coarse aggregate near the surface. The purpose of the screed is to level the surface of the panel and in this respect the height of the screed roller 22 can be varied by cranks 19 on the carriage of the machine according to standard screeding practice.

The packing roller 30 on machine 10 follows the screed roller and it will be noted that the packing roller rotates in the opposite direction to the screed roller. Hydraulic motor 31 rotates packing roller 30 and cranks 33 adjust its height in the frame. The purpose of the packing roller is to compact the concentrated coarse aggregate somewhat below the upper surface of the concrete. It has been found that by appropriately controlling the machine travel and speed of the packing roller that one can compact the concentrated coarse aggregate about $\frac{1}{8}$ of an inch below the surface and leave a layer of cement and fine aggregate above the compacted coarse aggretate. This condition is illustrated schematically in FIG. 4 of the drawings.

The general design and operation of a concrete finishing machine is well known and not referred to in detail in this specification. They are driven by hydraulic motors. The operation and design of vibrating screeds as generally indicated by the numeral 20 is well known to those in the art. The important elements are the rotatably mounted aggregate lifter 24 which can be raised or lowered by cranks 23, the screed roller 22 and the oppositely rotating packing roller 30 and its vertical height adjusting cranks 33. All rollers and the aggregate lifter can be raised or lowered with respect to the frame by related cranks according to practice with this type of machine. The number of passes will depend on circumstances and result required.

It will often be desirable to provide for more than the initial pass of the packing roller. In this case, the vibrating screed and aggregate lifter 24 are lifted above the wet concrete and the direction of rotation of roller 30 is reversed. Then, roller 22 is lowered to the same elevation as roller 30. The machine travel is then reversed and both rollers are working as packing rollers on the reverse travel. This sequence could be repeated as necessary. If a third pass is necessary, it would be done while the machine is travelling forward. At this stage, the rollers would be set to their original positions as far as rotation is concerned. It would not normally be necessary to use a vibrating screed or aggregate lifter on more than one pass.

In the casting of a concrete wall panel, wet concrete is poured into the mould 18. In FIG. 1 mould 18 has been illustrated as empty at its forward end as an indication of its construction. It will be appreciated that in practice the concrete fills the entire mould.

When the wet concrete has been poured into the mould the concrete finishing machine generally indicated by the numeral 10 is driven along its tracks by its hydraulic drive motor. The general operation of these machines is well known and not referred to in detail in this specification.

The vibrating screed operated by its hydraulic motor first engages the concrete. It is of standard design and has conventional scrapers at each side to prevent side spillage from the mould.

The concrete first levelled by the vibrating screed is next engaged by the arms 28 of the rotatably mounted aggregate lifter 24. This aggregate lifter is adjusted in height by means of cranks 23 so that the arms 28 engage in the upper layer of concrete and move the course aggregate in the concrete to the upper surface and deposit it in advance of the rotating screeding roller 22.

The arms 28 of the aggregate lifter pass through the shaft and extend from either side thereof as generally indicated in FIG. 2. They are made out of $\frac{1}{4}$ inch threaded rod and are maintained in position by a $\frac{1}{4}$ inch nut each side of the shaft. They have, in the embodiment of the invention built, a length of about 3 inches so that they extend on each side of the shaft 26 something less than 1 and $\frac{1}{2}$ inches. In use, they penetrate below the top of the levelled concrete a distance of about $\frac{3}{4}$ of an inch. The penetration is usually limited by reinforcing bars that are included in the concrete panel and are just over $\frac{3}{4}$ of an inch below the levelled surface.

The concrete is of standard specification but has aggregate of large size therein for ornamental purposes. Pebbles make good aggregate. Crushed rock can be used. The average diameter of popular aggregate is between $\frac{1}{4}$ inch and $\frac{5}{8}$ inch. One half inch is a good average size. The lifting arms 28 are spaced apart longitudinally of the shaft 26 a distance that will cause them to entrane such coarse aggregate as the aggregate lifter rotates, but also to permit passage through the wet concrete.

The screeding roller follows the aggregate lifter and it is rotated in a clockwise direction as illustrated in FIG. 2. This roller operates as a screed and is rotated in a direction to push excess surface concrete in advance of the roller. It will be noted that the aggregate lifter operates in a direction opposite to the screed roller to deposit the concentrated coarse aggregate directly in front of the screed roller 22.

The screed roller is adjusted as to height by normal concrete finishing machine practice, i.e. with the cranks 19.

The surface texture of the wet concrete after passage of the screed roller 22 has coarse aggregate concentrated at the top of the screed levelled surface of the poured concrete as illustrated schematically in FIG. 3.

As the concrete finishing machine 10 proceeds, the concrete is engaged by the compacting roller 30. This roller operates in the opposite direction of rotation to the screed roller and its purpose is to compact the concrete. As it does so, it compacts the coarse aggregate somewhat below the surface of the wet concrete and concentrates the cement and fine aggregate as an overlay for the coarse aggregate as schematically illustrated in FIG. 4.

When the machine has passed once over the bed the condition of the bed may be such that a second pass is required. In such event the vibrating screed and aggregate lifter are lifted to clear the bed. The machine is reversed in direction, the screeding roller 22 is set to the same elevation as roller 30 and roller 30 is reversed in rotation so that both rollers compact as the machine returns over the bed. Generally speaking, if a still further pass of the concrete finishing machine is required, the screeding roller and the finishing roller are set between 1/16 and 1/18 of an inch lower than their heights on the first pass.

When the surface of the wet concrete has been wet finished a liquid curing retardant is sprayed on the surface and the concrete panel is permitted to cure. After curing, the retardant covered surface is brushed to remove the cement matrix at the surface to which a retardant has been applied and leave the coarse aggregate exposed as schematically illustrated in FIG. 5.

The use of retardants is well known and not referred to in detail in this specification and techniques for exposing retardant covered surfaces are well known. Generally speaking, there is great variation possible in the exposing of the aggregate. It can be done by wire brush, high pressure water hose, by hand or by machine.

Embodiments of the invention other than the one referred to herein will be apparent to those skilled in the art and it is not intended that the foregoing specification should be read in a limiting sense.

What we claim as our invention is:

1. A method of making a cast concrete panel with coarse aggregate exposed on its upper face as cast comprising the steps of:

pouring and compacting wet concrete having a coarse aggregate content into a casting bed;

leveling the upper surface of the concrete to the desired height by means that includes the passage thereover of a screed roller rotating in a direction to push excess surface concrete in advance of the screed roller;

lifting coarse aggregate towards the upper surface of the concrete in advance of the screed roller by passing the free ends of rotating aggregate lifter arms through the concrete, the aggregate lifter-arms being spaced apart a distance to support coarse aggregate therebetween, whereby to lift and concentrate coarse aggregate in the wet concrete towards the surface, and to deposit a high concentration of coarse aggregate in front of said screed roller, said aggregate lifter arms being mounted radially of a rotating shaft that rotates in the opposite direction to the direction of rotation of the screed roller;

compacting the concentrated coarse aggregate to leave cement and fine aggregate as an overlay to the compacted coarse aggregate by the passage over the surface layer of a compacting roller that is rotated in the opposite direction to the screed roller with respect to the direction of travel of roller rotation along the casting bed to compact coarse aggregate and deposit cement and fine aggregate as an overlay as aforesaid;

permitting the body of the concrete to cure; and exposing the coarse aggregate on the upper face by removing cement and fine aggregate from between the coarse aggregate to expose the coarse aggregate on the flat upper surface of the panel as cast.

2. A method of making a cast concrete panel with coarse aggregate exposed on its upper face as cast as claimed in claim 1 wherein curing of the cement and fine aggregate overlay after compaction in said casting bed is retarded by application of a retarding composition.

* * * * *